United States Patent [19]

Okajima

[11] 4,208,961

[45] Jun. 24, 1980

[54] CAN COMPRESSOR

[76] Inventor: Tadashi Okajima, 1-12-6, Taishibashi, Asahi-Ku-Osaka, Japan

[21] Appl. No.: 969,181

[22] Filed: Dec. 13, 1978

[51] Int. Cl.[2] ..... B30B 1/04; B30B 7/00

[52] U.S. Cl. ..... 100/233; 100/DIG. 2; 100/218; 100/266

[58] Field of Search ..... 241/99; 100/DIG. 2, 100/233, 266, 218, 295

[56] References Cited

U.S. PATENT DOCUMENTS

| | | | |
|---|---|---|---|
| 2,128,630 | 8/1938 | Wright | 100/DIG. 2 |
| 2,161,931 | 6/1939 | Pattison | 100/DIG. 2 |
| 2,246,394 | 6/1941 | Steele | 100/233 |
| 2,373,057 | 4/1945 | Shinn | 100/DIG. 2 |
| 2,665,632 | 1/1954 | Kawa | 100/DIG. 2 |
| 2,968,235 | 1/1961 | Marica | 100/233 |
| 3,138,090 | 6/1964 | Moorhead | 100/DIG. 2 |
| 3,299,802 | 1/1967 | Black | 100/DIG. 2 |

*Primary Examiner*—Billy J. Wilhite

[57] ABSTRACT

A compressor for cans and the like. First and second plates are pivotally secured to each other for movement between open and closed positions, each of said plates including a planar bearing surface defining a compression area. In a preferred embodiment, the plates are non-parallel in the open position and generally parallel in the closed position with the location of the pivot connection being offset from the planes of both bearing surfaces. This offset facilitates ejection of the compressed material while reducing the forces which tend to prematurely eject the material to be compressed.

4 Claims, 7 Drawing Figures

CAN COMPRESSOR

BACKGROUND OF THE INVENTION

This invention relates to a device for compacting waste material and particularly to such a device for compressing or flattening cans and the like.

Modern packaging, and particularly food packaging, employs a large number of containers which retain their shape when the packaged material is removed. This results in storage and disposal problems when the packaged material is used or consumed in that the container occupies the same volume even though the packaged material is no longer contained within the container. Particularly at areas where people gather, such as parks and campgrounds, this unnecessary bulk soon fills disposal receptacles. These receptacles can hold far fewer containers than would be the case if those containers were crushed. The same is true during cartage of the containers from the collection site to the ultimate disposal site.

To ameliorate the situation described above, various container compressors, and particularly can compressors, have been proposed. These compressors have taken various forms but most typically employ two plates pivoted at or adjacent one end and movable toward each other under the urging of a lever. An example of such a system is described in U.S. Pat. No. 3,299,802, issued Jan. 24, 1967 to J. W. Black, Jr. for Device for Flattening Cans. The Black device employs a stationary plate and a movable plate pivoted together along the bottoms thereof. A can is placed between the plates and the movable plate urged toward the stationary plate to compress the can. However, there is no provision for removal of the crushed can which must be removed manually. In addition, the nature of the connection between the plates not only provides a crushing force but also induces a force having a tendency to urge the can out of the space between the plates. This is countered in the Black device by tooth like ridges on the inner surfaces of the plates.

Devices similar to the Black device are disclosed in U.S. Pat. No. 2,246,394, issued June 17, 1941 to J. W. Steel for Can Crushing Means and in U.S. Pat. No. 2,373,057, issued Apr. 3, 1945 to R. F. Shinn for Can Crusher. As with Black, each of these devices employ opposing plates pivoted at or adjacent the lower end of the plates with at least one plate being moved toward the other to crush the can. However, these devices overcome one shortcoming of the Black device by providing an opening along the lower portion of the plates such that the crushed material will fall through the device when the crushing pressure is relieved. They do not, however, address the problem of the tendency of the compressing force to drive the material to be compressed from the compression area. In addition, the nature of the pivotal connection between the plates places the pivot rod directly in line with the most natural ejection path for the compressed material, thereby producing a potential that the crushed material will encounter this obstruction and jam the compressor.

SUMMARY OF THE PRESENT INVENTION

The present invention provides a compressor for cans and the like which, like the prior art, employs two plates movable toward each other to compress material placed within the compression region. However, the present invention eliminates any obstructions within the natural ejection path of the compressed materials while also reducing the forces which tend to eject the material to be compressed from the compression area. In a preferred embodiment, a stationary plate is formed of a bearing surface and a chute with a second surface being movable from a first position where it is spaced from the bearing surface to a second position where it is in close proximity to and parallel to the bearing surface. The bearing surface and second plate are essentially planar surfaces pivotally movable relative to each other with the pivot location lying outside of both planes. That is, the plane of the bearing surface is intermediate the plane of the second plate and the pivot location thus eliminating the pivot connection as a potential obstruction on ejection of compressed materials. This "offset" also allows the second plate to move toward the first plate bearing surface in a more nearly parallel manner thereby reducing the forces tending to eject the material to be compressed from the compression area. Also, a more uniform pressure is applied over the entirety of the first plate bearing surface. These advantages will become apparent from the following detailed description of the drawings.

DETAILED DESCRIPTION OF THE DRAWINGS

Figure 1:
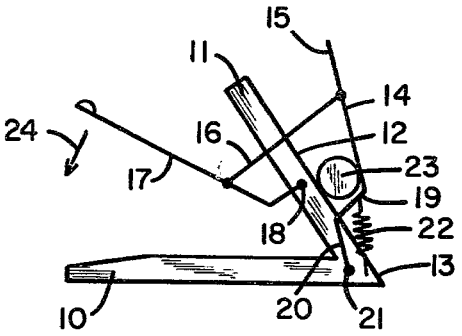
FIGS. 1–3 illustrate the operational characteristics of the present invention.

Referring now to FIG. 1, there is illustrated the operational characteristics of a preferred embodiment of the present invention. A base 10 supports a plate 11 in a non-horizontal position. The plate 11 includes a bearing surface 12 and chute portion 13 whose function will be described more fully below. A second plate 14 has a bearing surface 15 in opposing relation to the bearing surface 12, the bearing surfaces 12 and 14 being illustrated in FIG. 1 as spaced from each other and having a non-parallel relationship. That is, the plates 11 and 14 are spaced from each other with their upper portions being more distant than their lower portions such that a rigid container may be placed within the region between the surfaces 12 and 15 and descend in that region to a place where the distance between the surfaces 12 and 15 approximates the size of the container thereby holding the container within the compression area or region formed between the surfaces 12 and 15.

A link 16 extends between the plate 14 and a lever arm 17, the lever arm 17 being pivotally secured to the plate 11 at 18. A dogleg or offset 19 extends between the plate 14 and a linkage 20, the linkage 20 being pivotally secured to the base 10 at 21. A spring 22 biases the plates 11 and 14 in the "open" position illustrated in FIG. 1.

Figure 2:
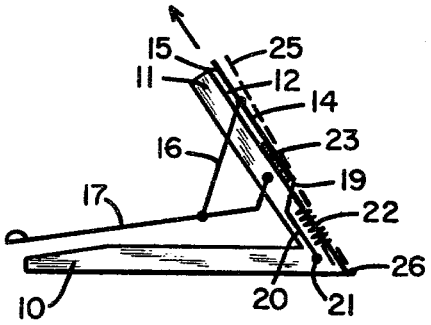

A can is illustrated within the compression region at 23. Movement of the lever arm 17 in the direction of the arrow 24 causes the plate 14 and surface 15 to move toward the plate 11 and surface 12. With sufficient force, the movement of those surfaces results in a crushing or compressing of the can 23 and the ultimate assumption of a "closed" relative position between the plates 11 and 14 as illustrated in FIG. 2. It should be noted in FIG. 2, that the dogleg or offset 19 allows the surface 15 to approach the surface 12 in a more nearly parallel relationship than would be the case if the offset were not provided. For example, the phantom line 25 in FIG. 2 illustrates the position of a surface pivoted at the point 26 (a typical prior art pivot point). As the surface 25 encounters the compressed can 23, further movement requires additional compression of the can 23 by additional force applied to the lever arm 17. In addition, the greater angularity between the surface 25 and the surface 12 results in an increase in the force in the direction of arrow 26, that force having a tendency to eject the compressed material, as well as an uneven compression over the entirety of the compression region defined by the bearing surface 12 and surface 15.

Figure 3:
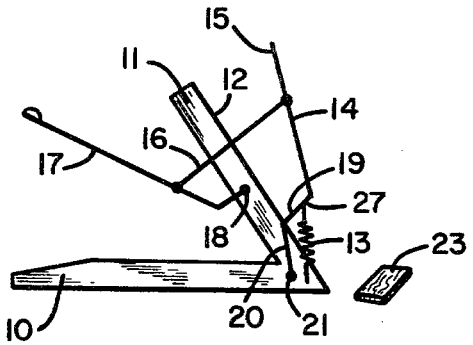

Referring now to FIG. 3, the can compressor of the present invention is illustrated again in the open position. However, FIG. 3 illustrates the automatic and unencumbered exit of the can 23, now compressed. In the open position, the surface 15 is again spaced from the surface 12 allowing the can 23 to fall through an aperture 27 between the lower edges of the surfaces 12 and 15. The chute formed at surface 13 directs the can 23 out of the compression region while the location of the pivot 21 results in no obstruction of the passage of the can 23 from the compression region. The chute 13 may be a continuation of the surface 12 or may have an angular relationship with that surface.

Figure 4:
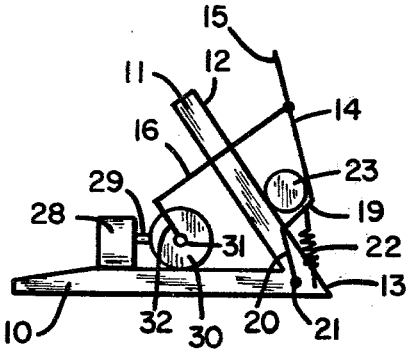
FIG. 4 illustrates another embodiment of the present invention.

Referring now to FIG. 4, there is illustrated a manner by which the can compressor of the present invention may be automated. A motor 28 has a shaft 29 connected to a speed reducing gear box 30. The output shaft 31 of the gearbox 30 is connected to the link 16 by a crank 32. As is apparent to those skilled in the art, as the crank 32 rotates the surface 15 will be alternately moved toward and away from the surface 12 thereby eliminating the need to manually provide the compressing force. All other operational aspects of the embodiment of FIG. 4 are the same as that described with reference to FIGS. 1–3, namely, the more parallel approach of the surface 15 to the surface 12 and the elimination of any obstructions in the ejection path.

Figure 5:
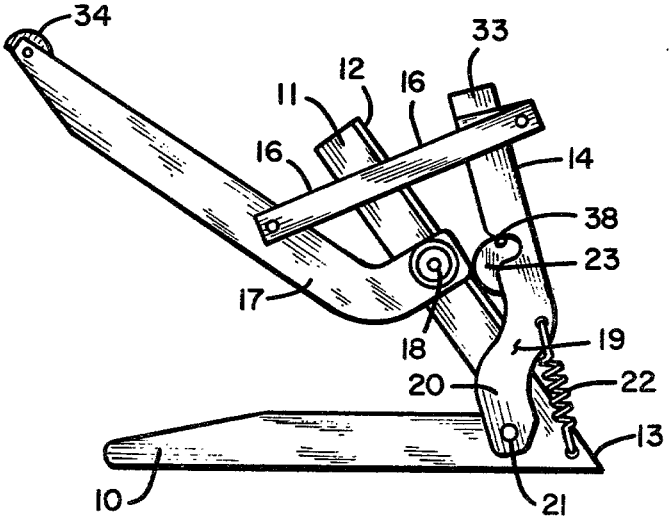
FIG. 5 is a side view of a preferred embodiment of the present invention.
Figure 6:
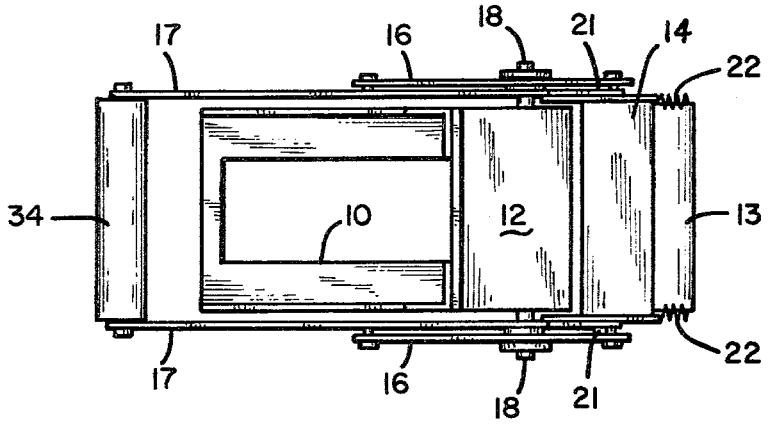
FIG. 6 is a top view of the embodiment of FIG. 5.

FIGS. 5 and 6 are side and top views, respectively, of a preferred embodiment of the present invention employing the operational characteristics discussed above with reference to FIGS. 1–3. In FIGS. 5 and 6, like reference numerals are employed to indicate elements functionally similar to the elements of FIGS. 1–3. As most clearly illustrated in FIG. 5, flanges 33 (one shown) extend from the edge of surface 15 to lie alongside the surface 12 in the closed position, the purpose of the flanges being to contain the material to be compressed within the compression region. The flange 33 may be unitary with the dogleg 19 and link 20 and is provided with a cutout 38 for clearance of the pivot pin 18. The embodiment of FIG. 5 is most conveniently operated by hand through the application of pressure to a handle 34.

Figure 7:
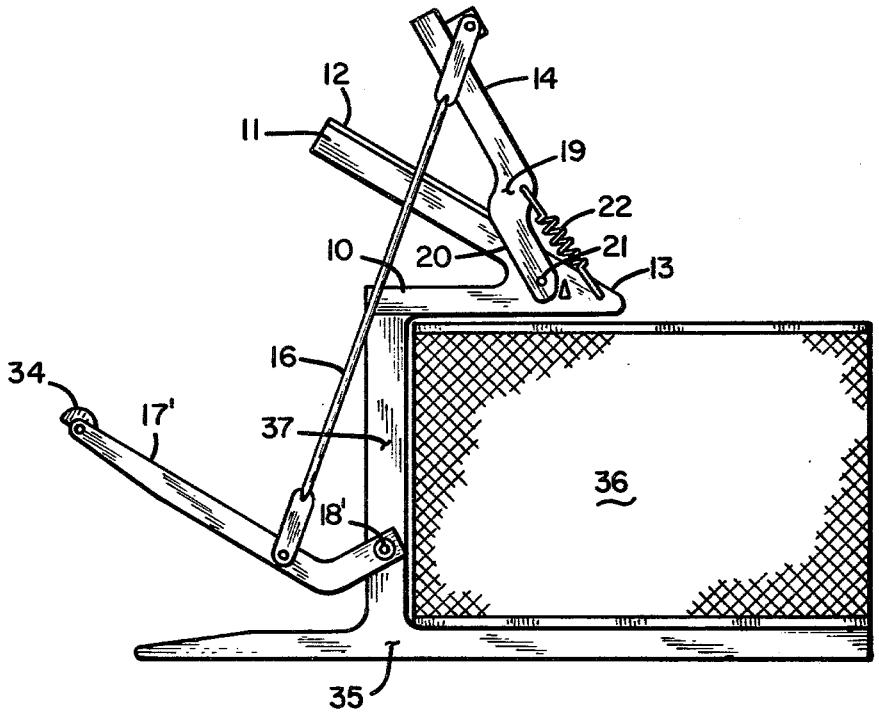
FIG. 7 is a side view illustrating another embodiment of the present invention.

Referring now to FIG. 7, there is illustrated a foot operated embodiment of the present invention. A base 35 supports a receptacle 36 and an upstanding column 37. The base 10 is supported on the column 37 with the chute 13 extending over an opening within the receptacle 36. A lever arm 17′ is supported by the column 37 at a pivot 18′ with a link 16 extending between the lever arm 17′ and plate 14. In operation, material to be compressed is placed within the compression region, the plate 14 is drawn toward the plate 11 via pressure applied to the handle 34 resulting in compression of the material within the compression region, the pressure is released with the spring 22 biasing the plates 11 and 14 to the open position with gravity then causing the compressed material to leave the compression region to be directed by chute 13 into the receptacle 36. The non-horizontal disposition of the surface 12 and the chute 13 results in an automatic ejection of the compressed material while the angular relationship between the bearing surface 15 of plate 14 (See FIGS. 1–3) and the bearing surface 12 retains the materials to be compressed within the compression region prior to compression. Of course, the embodiment of FIG. 7 could be automated in a manner similar to that illustrated above with reference to FIG. 4, or by any other convenient method. Other modifications and variations are similarly feasible without departing from the scope of the present invention. It is therefore to be understood that, within the scope of the appended claims, the invention may be practiced other than as specifically described.

What is claimed is:

1. In a compressor for cans and the like of the type having a first and second compressor plate, pivot means for allowing one of said plates to move between open and closed positions against the other plate and means for moving said plate between said open and closed positions, the improvement comprising:

(a) a base support member;

(b) said first plate mounted on an inclined plane and rigidly attached to said base support member;

(c) said second pivotally attached to said base support member;

(d) a lever pivotally attached to said base support member;

(e) an arm having ends respectively pivotally attached to said lever and said second plate, said arm and said lever limiting the maximum angular separation of said first and second plates to an acute angle, and permitting the minimum angular separation of said first and second plates to be substantially zero; and (f) spring biasing means attached to said base support member and said second plate for urging said second plate into spaced apart relationship from said first plate.

2. The improvement of claim 1, further comprising means for moving said lever.

3. The improvement of claim 2, wherein said means for moving further comprises a motor.

4. The improvement of claim 1, further comprising an opening below said first plate.

* * * * *